United States Patent [19]

O'Keeffe

[11] Patent Number: 4,494,804

[45] Date of Patent: Jan. 22, 1985

[54] STORAGE CABINET WITH PARTS SORTER

[76] Inventor: Lonnie O'Keeffe, P.O. Box 26194, El Paso, Tex. 79926

[21] Appl. No.: 315,412

[22] Filed: Oct. 27, 1981

[51] Int. Cl.[3] ..... B65D 91/00; B65B 67/02

[52] U.S. Cl. ..... 312/211; 312/126; 312/194; 312/234.1; 232/43.3; 232/43.4; 414/675

[58] Field of Search ..... 312/120, 121, 222, 123, 312/124, 234.1, 234.4, 211, 194, 209, 126, DIG. 33; 414/675; 232/43.3, 43.4, 12; 108/24, 25

[56] References Cited

U.S. PATENT DOCUMENTS

| | | | |
|---|---|---|---|
| 707,325 | 8/1902 | Hicks | 312/211 |
| 727,166 | 5/1903 | Lyon et al. | 312/209 |
| 1,659,230 | 2/1928 | Bacharias | 312/124 |
| 1,849,726 | 3/1932 | Reed | 312/194 |
| 2,664,224 | 12/1953 | Winneberger | 414/675 |
| 3,220,788 | 11/1965 | Hunckler | 312/234.1 |
| 3,255,894 | 6/1966 | Handel et al. | 414/675 |
| 3,305,283 | 2/1967 | MacKay | 312/234.4 |
| 3,348,894 | 10/1967 | De Berry | 312/209 |
| 3,655,253 | 4/1972 | Deeds et al. | 312/194 |
| 3,748,766 | 7/1973 | Hoesch | 312/234.1 |
| 3,848,395 | 11/1974 | Totten | 414/675 |
| 4,047,620 | 9/1977 | Deininger | 414/675 |
| 4,065,000 | 12/1977 | Murton | 414/675 |
| 4,155,611 | 5/1979 | Brekke et al. | 312/122 |

FOREIGN PATENT DOCUMENTS

| | | | |
|---|---|---|---|
| 1263927 | 2/1972 | United Kingdom | 414/675 |

*Primary Examiner*—Victor N. Sakran

*Attorney, Agent, or Firm*—Berman, Aisenberg & Platt

[57] ABSTRACT

A parts cabinet is provided with a simple means for inspecting the contents of a drawer and returning the contents to the drawer. The cabinet is provided with a tray, either as a separate element or integral with the cabinet top, into which the contents of the tray may be emptied. The tray has a hole beneath which an empty drawer is placed. When objects in the tray are scraped through the hole they fall into the drawer. Means are provided for visually indicating whether a drawer is in place beneath the hole.

8 Claims, 10 Drawing Figures

FIG.4
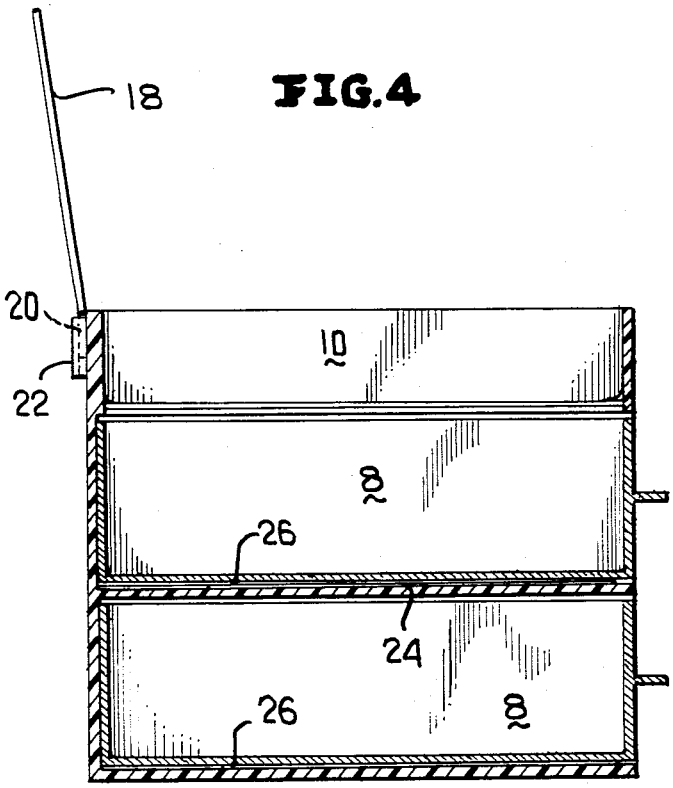
FIG.7
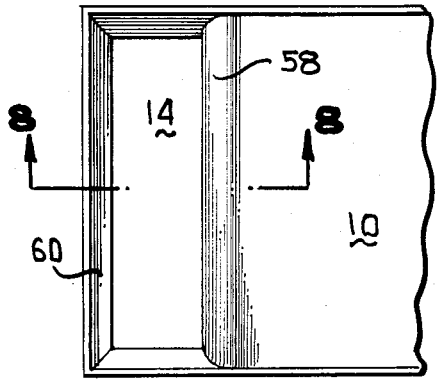
FIG.8
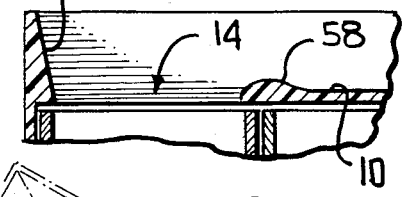
FIG.5
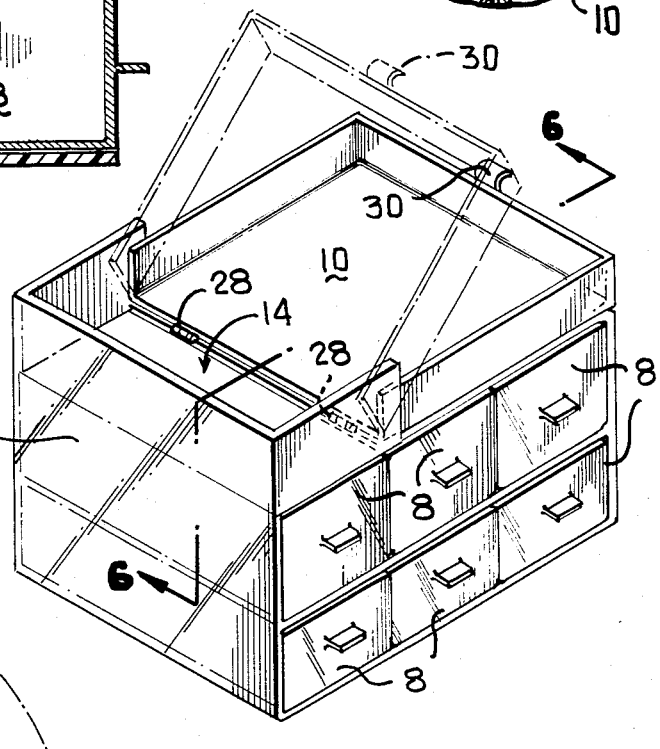
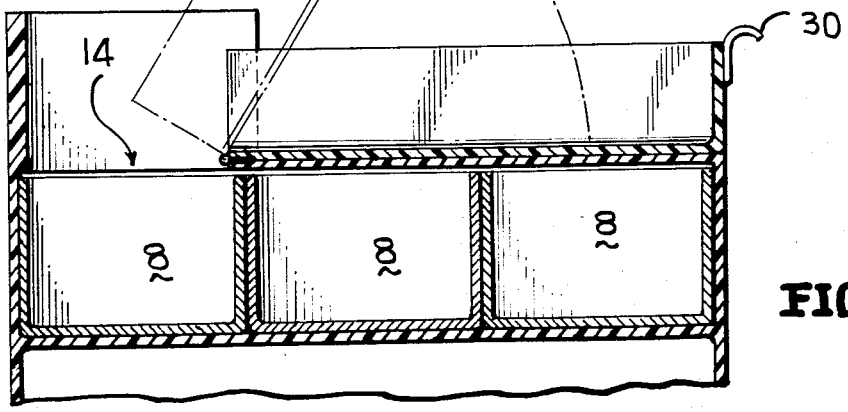
FIG.6

STORAGE CABINET WITH PARTS SORTER

TECHNICAL FIELD

This invention relates to cabinets with drawers for storing a plurality of items and means for inspecting the items in a drawer for easy selection of a given item and return of the remainder of the items to the drawer.

BACKGROUND ART

Cabinets with drawers for the storage of small items are known in the art. These cabinets may take the form of a metal or plastic box with either shelves or runners for supporting drawers in the interior of the box. The drawers are typically filled with such small shop items as nuts or bolts or washers, etc. One such cabinet is shown in the U.S. Pat. No. 4,155,611.

STATEMENT OF THE INVENTION

While storage cabinets for small parts are known in the art, one problem associated with these cabinets is that of extracting a desired item from among a drawer full of other similar but undesired objects. Typically, the contents of the drawer are dumped on the floor or on a countertop and spread out so that the desired item may be located. The undesired items are then scooped up and placed back in the drawer. This process is undesirable since adequate countertop space may not be available, and because the floor is usually dirty, the dirt from the floor finds its way into the drawer with the unwanted items. Furthermore, scooping up the items is quite inconvenient, with many of the items rolling away and becoming lost, and dangerous if the items are sharp such as screws so that the operator's hands are cut in the process of scooping up the objects.

It is an object of the present invention to provide an apparatus whereby the contents of a drawer may be emptied into a confined tray and easily returned to the drawer.

The apparatus of the invention includes a tray which fits on top of a parts cabinet and includes an opening which may be covered when the items are emptied into the tray and through which the items may be scraped to return the items to the drawer. The cover for the hole also acts as a scraper for returning the objects through the hole and into the drawer.

In a second embodiment of the invention, a portion of the tray is tiltable so as to allow one to pour the items back into the drawer.

The subject of the invention may be constructed as part of a new cabinet or in another embodiment may be added to an existing cabinet.

BRIEF DESCRIPTION OF THE DRAWINGS

FIG. 4 is a cross section taken along line 4—4 of FIG. 2.

FIG. 5 is a perspective view of a second embodiment of the invention.

FIG. 6 is a cross section taken along line 6—6 of FIG. 5.

FIG. 7 is a plan view of a third embodiment of the invention.

FIG. 8 is a cross section taken along line 8—8 of FIG. 7.

DETAILED DESCRIPTION OF THE INVENTION

Figure 1:
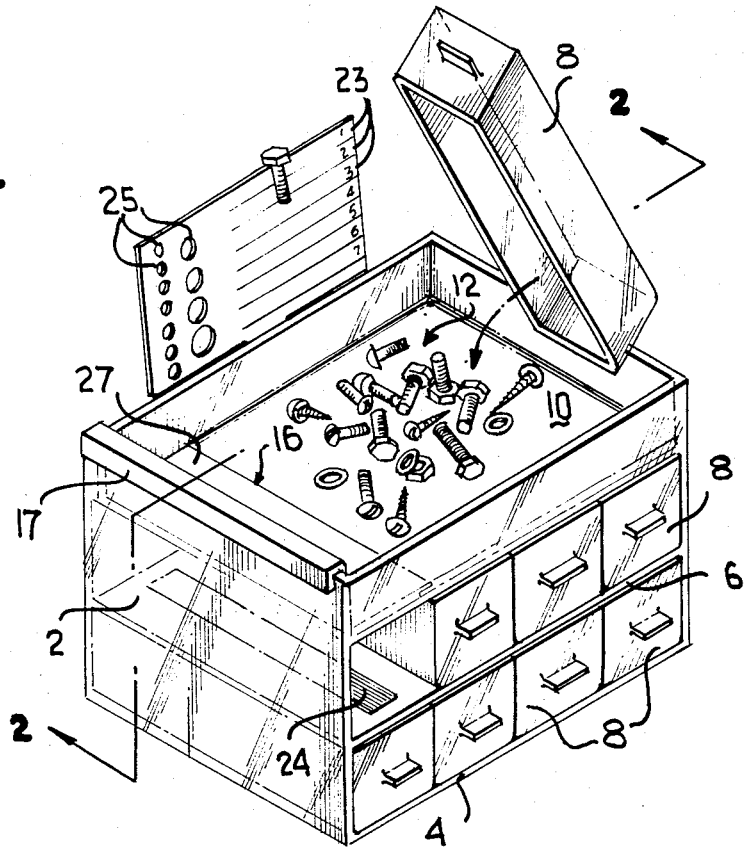
FIG. 1 is a perspective view of one embodiment of the invention.

FIG. 1 shows a cabinet of the invention which has side walls 2, a bottom wall 4 and a shelf 6. Rows of drawers 8 are supported by the shelf 6 and bottom wall 4. It will be clear to one of skill in the art that the drawers may be supported by any conventional method such as by runners which support the longitudinal edges of the drawers. The top of the inventive cabinet has a recessed tray 10. In FIG. 1, there is shown a plurality of small objects 12 which have been emptied from the drawer 8 into the tray 10. The tray 10 has a hole 14 (shown in FIG. 2) which in FIG. 1 is shown covered with a combination cover and scraper 16.

The cover and scraper 16 has a U-shaped lip 17 which hooks over side wall 2 when the cover and scraper 16 is in place. The cover and scraper 16 has a notch 19 one edge which mates with groove 21 in one edge of the hole 14. Thus, when the cover and scraper 16 is in place over hole 14 the lip 17 and notch 19 act to provide a secure covering. The cover and scraper has a horizontal portion 27 and a vertical portion 29.

A chart 18 which has indicia 23 for determining the length of a bolt, and holes 25 for determining the diameter of a bolt is supported on the rear edge of the recessed tray in any convenient manner, such as by the cooperation of a tongue 20 on the plate 18 and a slot 22 in the tray edge.

Figure 2:
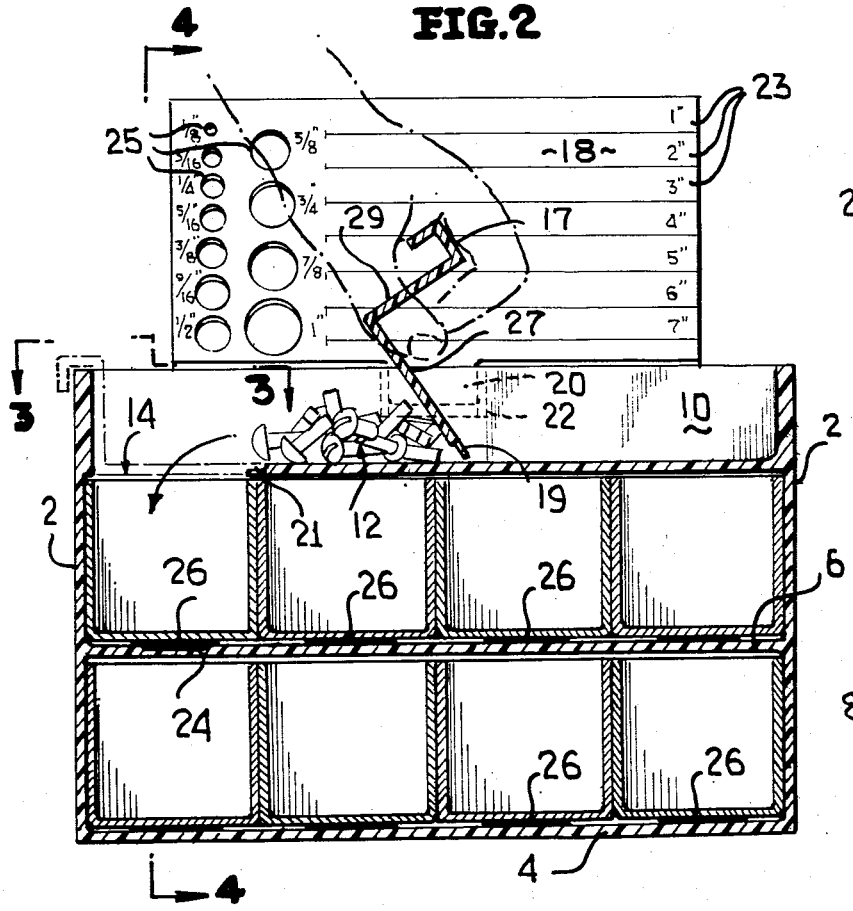
FIG. 2 is a cross sectional view taken along line 2—2 of FIG. 1.
Figure 3:
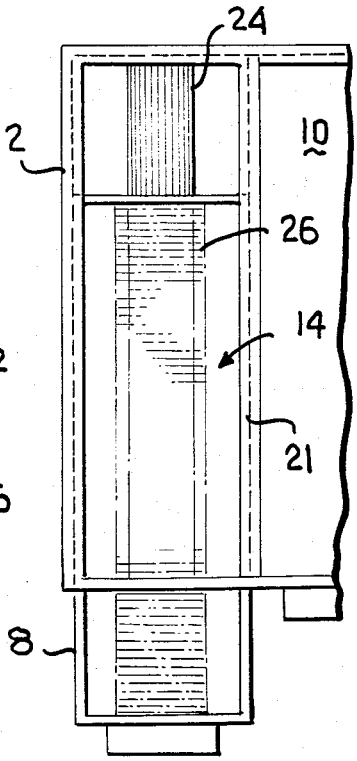
FIG. 3 is a horizontal view taken along line 3—3 of FIG. 2.

While the inventive cabinet is shown in FIG. 1 in preparation for the selection of an object from the group of objects 12, the invention is shown in FIG. 2 being used to return the unwanted objects to the drawer. The combination cover and scraper 16 is removed from its position covering the hole shown in FIG. 1 and is used to push the unwanted objects through the hole and back into the drawer. The vertical portion 29 and the U-shaped lip 17 combine to provide a convenient handle for the cover and scoop. Of course, the drawer 8 into which the objects are to be placed, must have been put into position beneath the hole 14 before the objects 12 are pushed through the hole. In order to insure that a drawer is beneath the hole, a piece of tape or painted strip 24 is placed on the shelf below the hole. If no drawer is beneath the hole, the colored tape or strip will be visible, thus warning the user not to scrape the objects through the hole. On the other hand, if a drawer is in place beneath the hole, the tape will be obscured by either an opaque bottom on the drawer or a painted strip 26 which will cover the tape 24 when the drawer is in position below the hole 14.

FIG. 5 shows a second embodiment of the invention where instead of having a scraper for pushing the items back into the drawer, the tray 10 is pivotally attached to one side of the hole by hinges 28 so that when one end of the tray is raised, as shown by the dashed lines, the items 12 will fall through the hole and into the drawer 8. A handle 30 is attached to one edge of the pivotable tray to aid in grasping the tray.

FIGS. 7 and 8 show a third embodiment of the invention. FIG. 7 is a plan view of a portion of the top of the cabinet shown in FIG. 1. Instead of a cover and scoop 16 this embodiment has a raised portion 58 which serves to prevent the objects from accidentally falling into the hole 14. When desired, the objects may be scraped over the raised portion 58 through the hole 14, and into drawer 8. The embodiment shown in FIGS. 7 and 8 has inclined sides 60 which act to funnel the objects 12 into the drawer.

Figures 9, 9A:
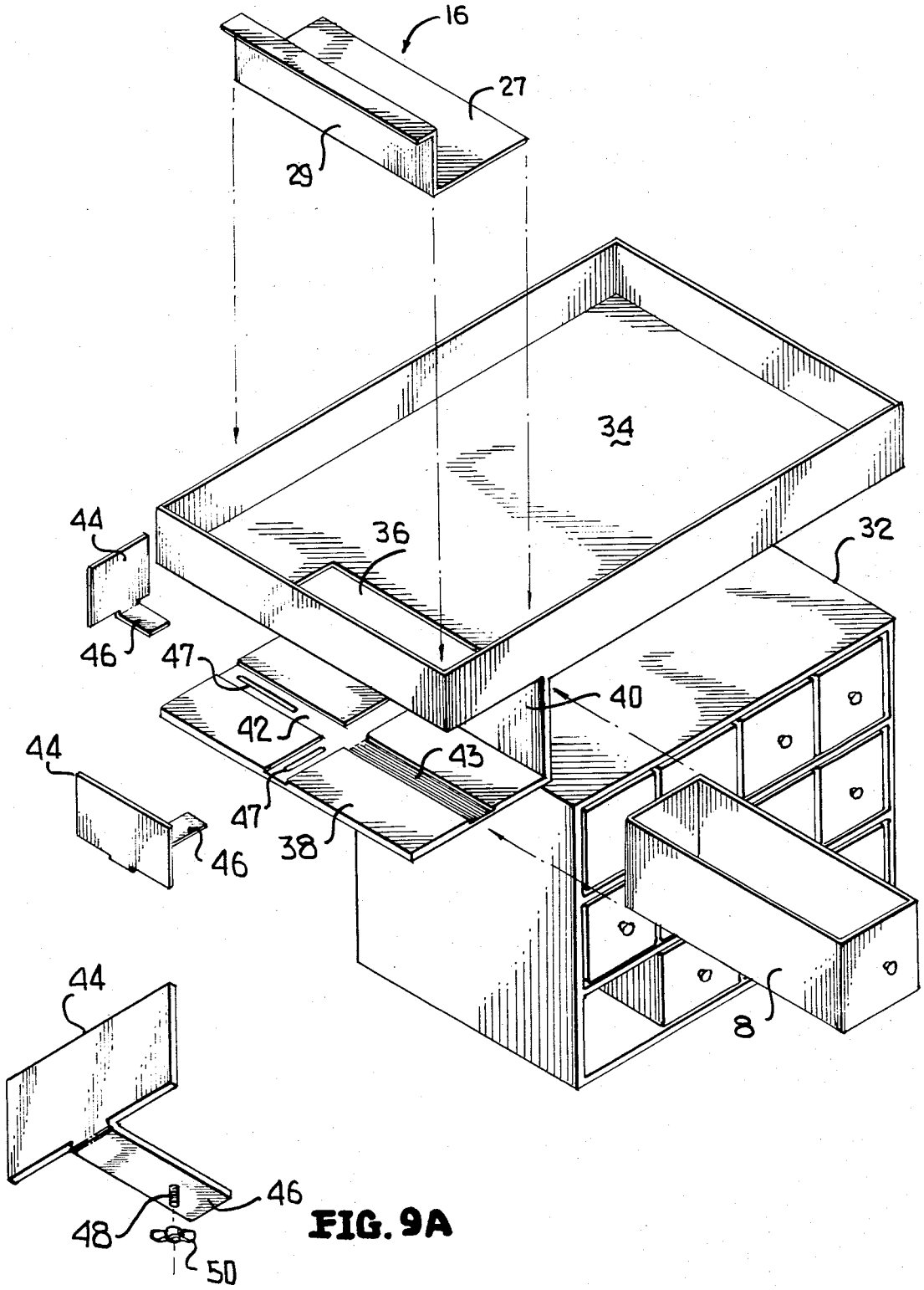
FIG. 9 is a perspective view of a fourth embodiment of the invention.
FIG. 9A is a detail view of a drawer guide.

FIG. 9 shows still another embodiment of the invention which is an attachment for the top of a prior art cabinet to accomplish the purposes of the invention. The prior art cabinet is shown as 32 and an attachment tray is shown as 34. The tray may be secured to the cabinet by double faced tape or other means. The attachment tray has a hole 36 therein. Located beneath the hole 36 is a shelf 38 supported by a wall 40. The shelf 38 is positioned such that when a drawer 8 is placed on the shelf, it will be located beneath the hole 36. Shelf 38 has grooves 42 therein. Drawer guides 44 have protrusions 46 which fit into the grooves 42. When the protrusions 46 are placed at an appropriate location along the grooves 42, the drawer guides 44 will cooperate with the shelf 38 to accomodate a wide variety of drawers. Combination cover and scraper 16 covers hole 36 as in the embodiment of FIG. 1. As shown in FIG. 9*a*, the protrusions 46 may have a stud 48 extending therefrom to which a wing nut 50 is attached to secure the drawer guide to the shelf. Groove 42 may have a strip 43 which acts like previously described strip 26. The grooves have slots 47 which receive the studs 48.

A cabinet according to the invention may include a handle for carrying the parts cabinet. Also, the inventive parts cabinet may include a door which is pivotally attached to the side walls 2 of the cabinet such that when the door is folded down the drawers may be opened and when the door is folded up and latched the drawers will be prevented from sliding out.

Thus it may be seen that according to the invention a parts cabinet, and an attachment to a prior art cabinet, are provided by which an easily accessible tray is available for aid in selecting a small article from among the contents of a drawer, and means are provided for expeditiously returning the remainder of the small items to the drawer through a hole in the tray beneath which the drawer is placed.

What is claimed is:

1. Apparatus for facilitating inspection of a plurality of objects, and the subsequent placement of objects in a drawer consisting of:

a tray having a peripheral upstanding rim and a bottom for receiving said plurality of objects, said bottom having a hole therein, means for supporting a drawer beneath said hole, and cover means for covering said hole, said cover means being removable so that said hole may be uncovered, said cover means having an edge with a straight portion, whereby said cover means may act as a scraper for pushing said objects through said hole, whereby said objects may be placed in said drawer by allowing them to fall through said hole.

2. The apparatus of claim 1 wherein said cover means includes a lip which is adapted to engage an edge of said tray, and wherein said straight portion has a notch which is adapted to engage one edge of said hole.

3. Apparatus for facilitating inspection of a plurality of objects, and the subsequent placement of the objects in a drawer, consisting of:

a tray having a peripheral, upstanding rim and a bottom for receiving said plurality of objects, said bottom having a hole therein, means for supporting a drawer beneath said hole, whereby said objects may be placed in said drawer by allowing them to fall through said hole, and wherein a first portion of said tray is pivotally attached to a second portion of said tray adjacent said hole, whereby said objects will be directed to said hole when one edge of said first portion has been raised.

4. A cabinet comprising a plurality of drawers, each of said plurality of drawers being adapted to receive a plurality of small objects, a frame for holding said plurality of drawers and including a top surface having an upstanding peripheral rim, said top surface having a hole therein in alignment with a portion of said frame adapted to receive any of said plurality of drawers so that said small objects are placed on said top surface for inspection and placed in one of said drawers through said hole, and cover means for covering said hold.

5. The cabinet of claim 4, said cover means being removeable from said hole and having an edge with a straight portion whereby said cover may serve as a scraper to push said objects through said hole.

6. The cabinet of claim 5 wherein said cover includes a lip for engaging said upstanding rim.

7. The cabinet of claim 4 wherein a first portion of said top is pivotally attached to a second portion adjacent said hole so that said objects may be directed to said hole by rotation of said first portion.

8. The cabinet of claim 4 further comprising indicia on said portion of said frame indicating presence or absence of one of said drawers in said portion of said frame.

* * * * *